US010472869B2

(12) United States Patent
Fannon et al.

(10) Patent No.: US 10,472,869 B2
(45) Date of Patent: Nov. 12, 2019

(54) POWERED LATCH MECHANISM WITH MANUAL RELEASE

(71) Applicant: STRATTEC SECURITY CORPORATION, Milwaukee, WI (US)

(72) Inventors: Joseph P. Fannon, Washington, MI (US); Ian Martin, Waterford, MI (US)

(73) Assignee: STRATTEC SECURITY CORPORATION, Milwaukee, WI (US)

( * ) Notice: Subject to any disclaimer, the term of this patent is extended or adjusted under 35 U.S.C. 154(b) by 657 days.

(21) Appl. No.: 15/068,223

(22) Filed: Mar. 11, 2016

(65) Prior Publication Data

US 2016/0312499 A1 Oct. 27, 2016

Related U.S. Application Data

(60) Provisional application No. 62/132,139, filed on Mar. 12, 2015.

(51) Int. Cl.

| | |
|---|---|
| ***E05B 81/90*** | (2014.01) |
| ***E05B 81/14*** | (2014.01) |
| ***E05B 81/06*** | (2014.01) |
| ***E05B 81/20*** | (2014.01) |
| ***E05B 81/46*** | (2014.01) |
| *E05B 79/20* | (2014.01) |
| *E05B 81/36* | (2014.01) |
| *E05B 83/16* | (2014.01) |

(52) U.S. Cl.

CPC ..... *E05B 81/90* (2013.01); *E05B 81/06* (2013.01); *E05B 81/14* (2013.01); *E05B 81/20* (2013.01); *E05B 81/46* (2013.01); *E05B 79/20* (2013.01); *E05B 81/36* (2013.01); *E05B 83/16* (2013.01)

(58) Field of Classification Search

CPC ..... E05B 81/90; E05B 81/06; E05B 81/14; E05B 81/20; E05B 81/34; E05B 81/36; E05B 81/46; E05B 79/20; E05B 83/16; Y10T 292/1047; Y10T 292/1082; Y10S 292/23

See application file for complete search history.

(56) References Cited

U.S. PATENT DOCUMENTS

| | | | | |
|---|---|---|---|---|
| 5,232,253 | A | 8/1993 | Tamiya | |
| 5,639,130 | A * | 6/1997 | Rogers, Jr. | E05B 81/20 292/199 |
| 5,876,074 | A | 3/1999 | Dowling | |
| 6,053,542 | A | 4/2000 | Ostrowski et al. | |

(Continued)

*Primary Examiner* — Alyson M Merlino
(74) *Attorney, Agent, or Firm* — Michael Best & Friedrich LLP

(57) ABSTRACT

A powered latch includes a forkbolt pivotable about a first axis between a latched position for retaining a striker and an unlatched position for releasing the striker. A detent lever is pivotable about a second axis and engageable with the forkbolt to secure the forkbolt in the latched position. The latch further includes a powered actuator and a power release lever rotatable about a third axis by the powered actuator to release the detent lever from the forkbolt. The power release lever is manually movable along the third axis from a first position to a second position. Movement of the power release lever from the first position to the second position is operable to release the detent lever.

17 Claims, 9 Drawing Sheets

(56) References Cited

U.S. PATENT DOCUMENTS

| | | | | |
|---|---|---|---|---|
| 6,499,776 | B2 | 12/2002 | Takamura | |
| 6,669,247 | B2 | 12/2003 | Swan | |
| 6,918,275 | B2 | 7/2005 | Martus et al. | |
| 7,232,161 | B2 * | 6/2007 | Matsuda | E05B 81/06 292/100 |
| 7,472,628 | B2 | 1/2009 | Oberheide | |
| 2004/0239124 | A1 * | 12/2004 | Larsen | E05B 81/14 292/201 |
| 2006/0131893 | A1 * | 6/2006 | Tomaszewski | E05B 81/06 292/216 |
| 2009/0236863 | A1 * | 9/2009 | Akizuki | E05B 81/14 292/201 |
| 2012/0248796 | A1 | 10/2012 | Kurebayashi | |

* cited by examiner

POWERED LATCH MECHANISM WITH MANUAL RELEASE

CROSS-REFERENCE TO RELATED APPLICATIONS

This application claims priority to U.S. Provisional Patent Application No. 62/132,139, filed Mar. 12, 2015, the entire contents of which are incorporated by reference herein.

BACKGROUND

The invention relates to latch mechanisms, such as those used in automotive applications including, but not limited to, truck end gates or "tailgates", vehicular rear hatches, lift gates, trunks, and side entry doors.

Electrically-powered release latches have posed a challenge in assembly plants when it becomes necessary to open a door or gate before power is supplied to the vehicle. As such, some latches have been modified with the addition of a dedicated mechanical release device, such as a lever that can be actuated by manually pulling an attached tether. This function becomes significantly more complex when the electric release latch also provides a power cinching function for electrically closing the door or gate, as the cinching mechanism must be disengaged prior to manual release. Thus, power cinching and release latches may employ complex mechanisms for disengaging the cinching mechanism and subsequently releasing the latch, or in some cases, may require destructive disassembly of the latch to disengage the cinching mechanism.

SUMMARY

In one aspect, the invention provides a powered latch including a forkbolt pivotable about a first axis between a latched position for retaining a striker and an unlatched position for releasing the striker. A detent lever is pivotable about a second axis and engageable with the forkbolt to secure the forkbolt in the latched position. A power release lever is rotatable about a third axis by a powered actuator to release the detent lever from the forkbolt. The power release lever is manually movable along the third axis from a first position to a second position. Movement of the power release lever from the first position to the second position is operable to release the detent lever.

In another aspect, the invention provides a method of manually operating multiple latches of a vehicle during assembly. Multiple latches are provided on one of a vehicle closure and a vehicle body, each of the latches being configured to selectively engage and retain a respective striker provided on the other of the vehicle closure and the vehicle body. Each latch includes an actuator operable, when powered, to rotate a respective power release lever to release the striker from the latch. The actuators of the latches are provided with no power during an assembly phase of the vehicle. A tether is coupled to the respective power release levers of at least two of the multiple latches. The tether is pulled, during the assembly phase, to manually actuate the power release levers of the at least two latches, in a direction perpendicular to the rotational direction of each of the power release levers, to release the strikers from the respective latches.

In yet another aspect, the invention provides a powered latch including a forkbolt pivotable about a first axis between a latched position for retaining a striker and an unlatched position for releasing the striker. A detent lever is pivotable about a second axis and engageable with the forkbolt to secure the forkbolt in the latched position. A powered actuator is operable to rotate a power release lever about a third axis for releasing the detent lever from the forkbolt. The power release lever is movable along the third axis to a manual release position in which the power release lever is decoupled from the powered actuator, the movement to the manual release position simultaneously actuating the releasing of the detent lever.

Other aspects of the invention will become apparent by consideration of the detailed description and accompanying drawings.

DETAILED DESCRIPTION

Before any embodiments of the present invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
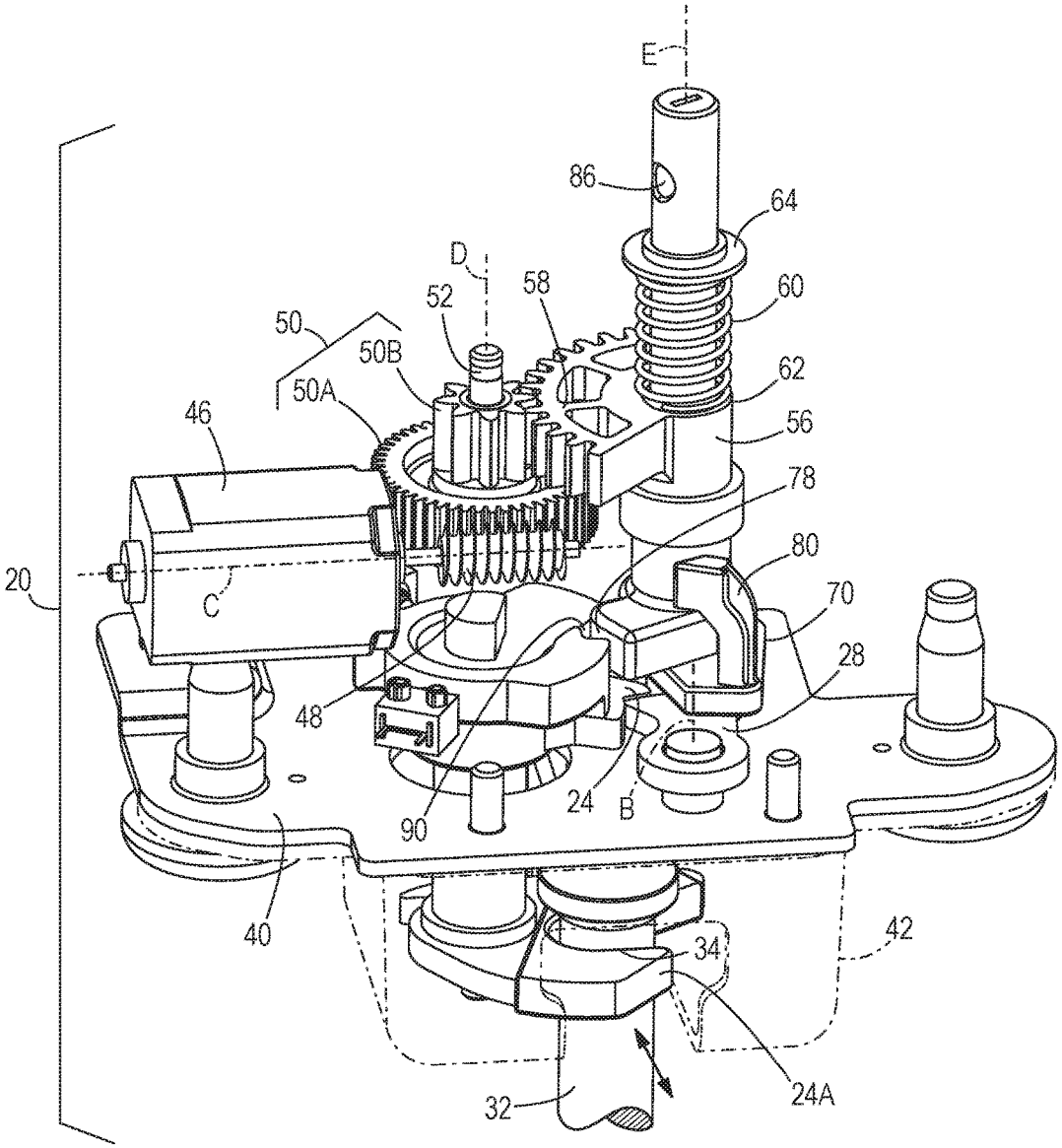
FIG. 1 is a perspective view of a latching assembly according to one embodiment of the present invention.
Figure 2:
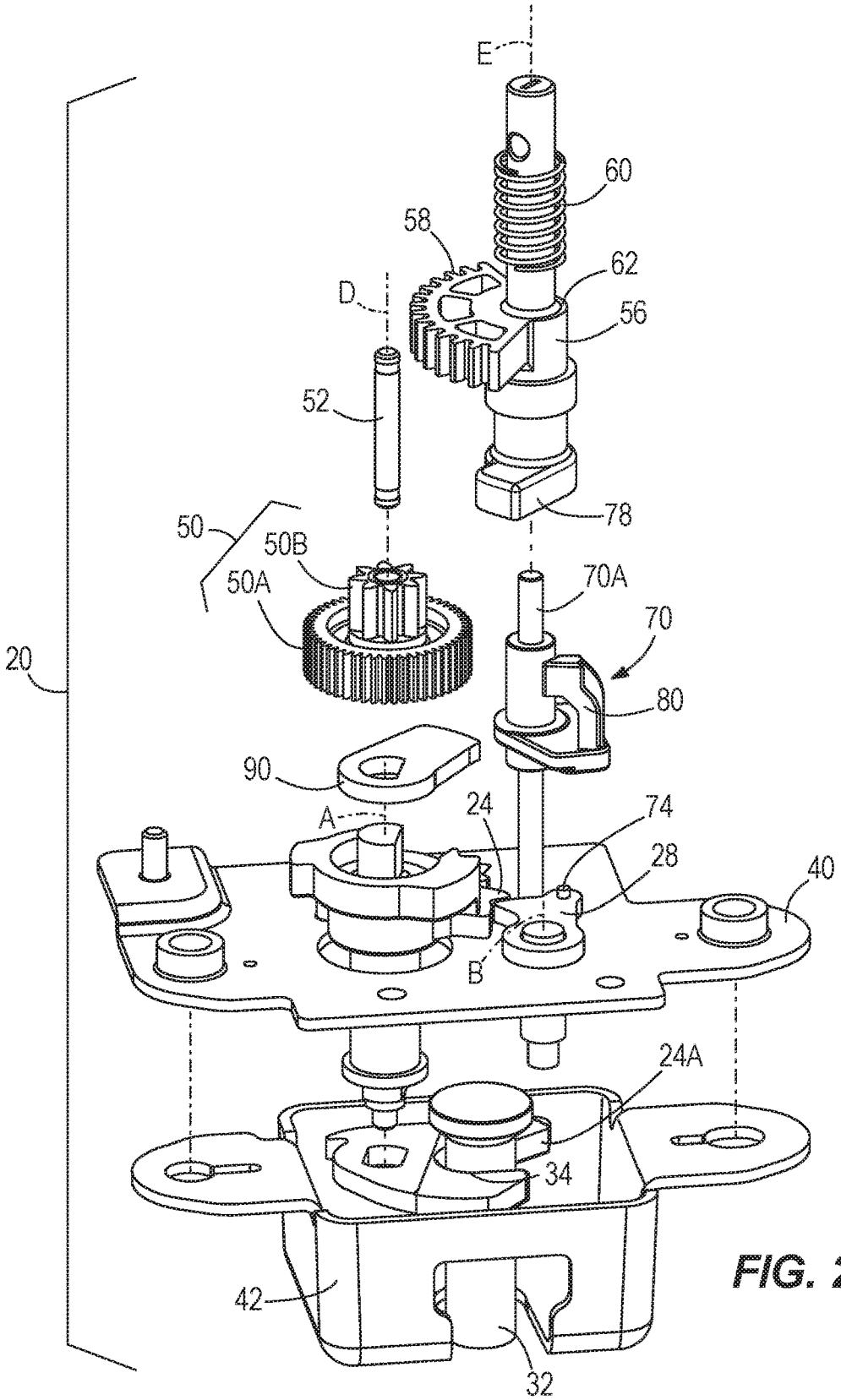
FIG. 2 is an exploded assembly view of the latching assembly of FIG. 1.
Figure 3:
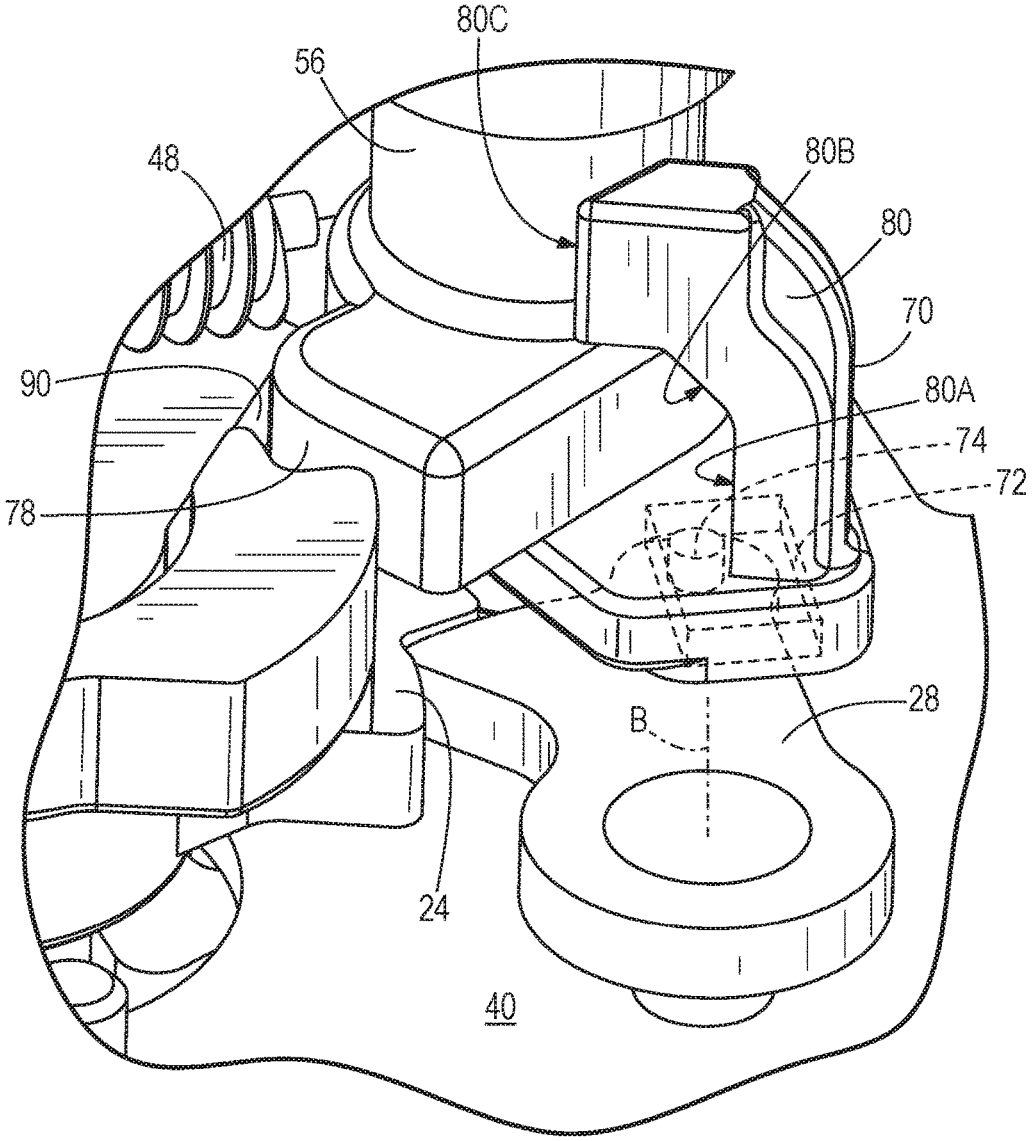
FIG. 3 is a detail perspective view illustrating the engagement between a detent and an intermittent lever operable to actuate the detent to release the latch assembly.

FIGS. 1 and 2 illustrate a latch assembly, or simply, latch 20 which may be used to selectively hold shut a closure (e.g., a vehicle entry door, hatch, tailgate or end gate, decklid or trunk, and the like). A housing 22 (see FIG. 10) of the latch 20 is removed to illustrate the internal components. The latch 20 includes a catch, referred to herein as forkbolt 24 and a pawl, referred to herein as detent lever 28. The forkbolt 24 is rotatable about a first axis A to selectively engage and trap a striker 32, and the detent lever 28 is positioned adjacent the forkbolt 24 and is pivotable about a second axis B parallel with the first axis A of the forkbolt 24. The detent lever 28 has an engagement surface configured to engage one or more corresponding engagement surfaces of the forkbolt 24 to retain the forkbolt 24 in one or more latched positions, retaining the striker 32 as shown in FIG. 1. These may include a half-latched or safety-latched position and a fully-latched position. In the case of automotive closures and the like, the striker 32 may be fixed to a body (e.g., door frame, truck bed, or pillar), and the latch 20 may be mounted at the edge of the particular closure that is swingable or slidable relative to the body, although these positions of the striker 32 and latch 20 can be reversed in other embodiments. Although the illustrated embodiment includes a separate "primary" forkbolt 24A engaged for rotation with the forkbolt 24 and provided with a groove 34 to directly receive the striker 32, the latch 20 can be provided with a single forkbolt that directly engages both the striker 32 and the detent lever 28 (e.g., the forkbolt 24 and the primary forkbolt 24A as shown can be provided integrally as a single piece). As shown in FIGS. 1 and 2, working components of the latch 20 can be supported by a backing plate 40. For example, the forkbolt 24 and the detent lever 28 are rotatably supported by the backing plate 40. Furthermore, a frame plate or latch frame 42 is coupled to the backing plate 40 and provided to enclose or surround the portion of the forkbolt (e.g., primary forkbolt 24A) having the groove 34 which engages the striker 32. An opening in the latch frame 42 allows entry and exit of the striker 32 generally along the path shown by the double arrow at the bottom of FIG. 1.

The closure is opened by releasing the detent lever 28 from the engaged position of FIG. 1 so that the forkbolt 24 can rotate about the first axis A to free the striker 32. When the closure is moved toward the closed position, the striker 32 is forced into the groove 34, thereby rotating the forkbolt 24 toward the latched position of FIG. 1. The detent lever 28 can be spring-biased into retaining engagement with the forkbolt 24.

As described in further detail below, the latch 20 is a powered latch assembly. As such, the detent lever 28 can be released or disengaged from the forkbolt 24 by a powered (e.g., electric) actuator, such as the illustrated electric motor 46. The provision of a powered actuator provides that releasing the latch 20 can be accomplished in a normal mode of operation, without applying human power, although human-applied power may be utilized to release the latch in another mode of operation. The motor 46 has an output member or gear, which is a worm gear 48 in the illustrated construction, although other drive arrangements are optional. The motor 46 drives the worm gear 48 to rotate about an axis C. The worm gear 48 is in meshed driving engagement with a first toothed portion 50A of a gear wheel 50. The gear wheel 50 is rotatable about an axis D, which is perpendicular to the axis C of the motor 46 and the worm gear 48. The gear wheel 50 further includes a second toothed portion 50B which is integral with the first toothed portion 50A or is otherwise coupled for rotation therewith. The gear wheel 50 is supported on a shaft 52 as shown in FIGS. 1 and 2.

Figure 10:
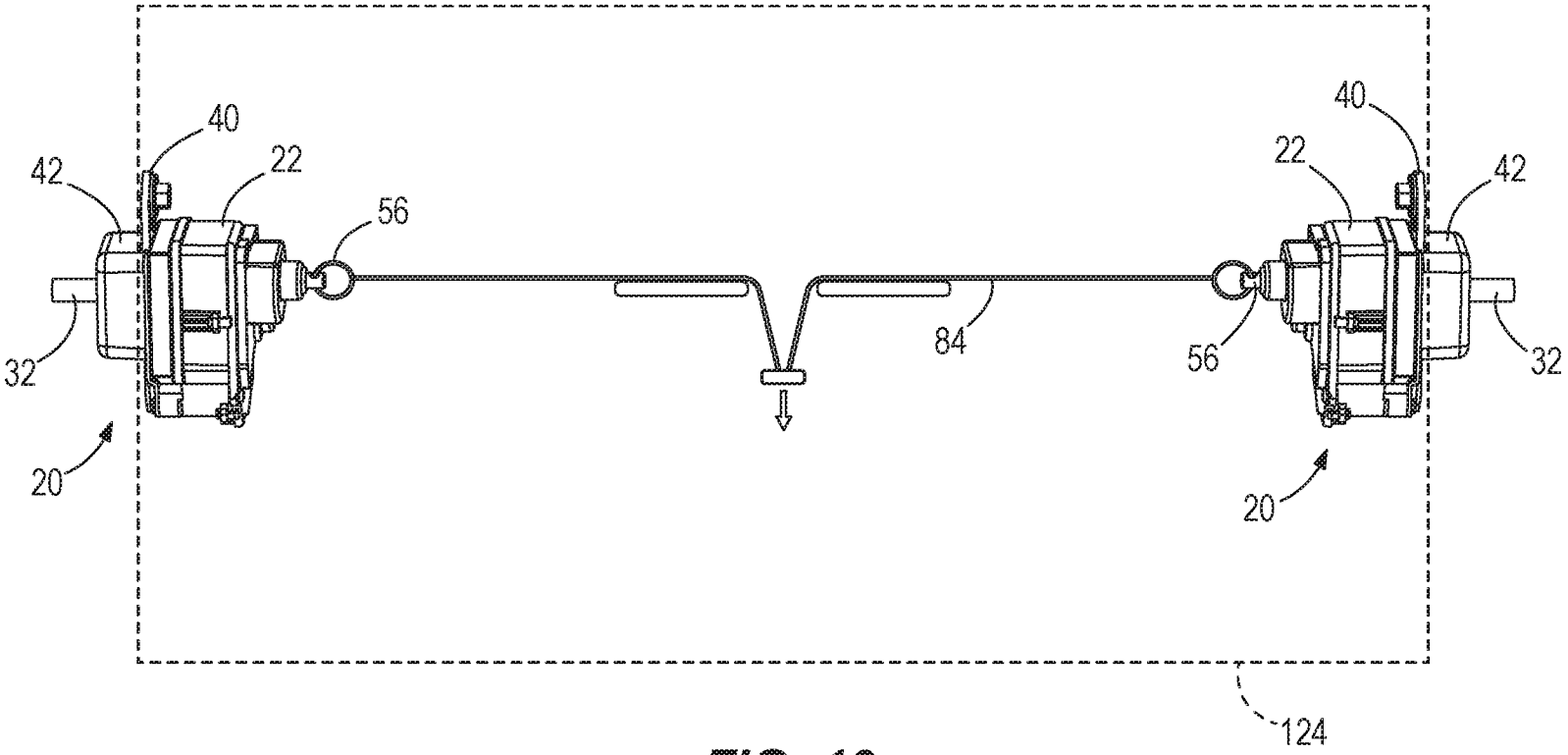
FIG. 10 is a perspective view of a coupling between two of the latch assemblies of FIG. 1 to provide mutual manual release with a tether member.

The second toothed portion 50B of the gear wheel 50 is in meshed driving engagement with a power release lever 56. As shown in the illustrated construction, the power release lever 56 can include a gear portion 58 that is selectively meshed with the second toothed portion 50B of the gear wheel 50. The power release lever 56 is rotatable about an axis E. The axis E of the power release lever 56 is parallel with the axis D of the gear wheel 50 and perpendicular to the axis C of the motor 46, but alternate arrangements are optional. As described in further detail below, the power release lever 56 is also movable to translate along the axis E in a particular operational mode to disengage the gear portion 58 from the second toothed portion 50B of the gear wheel 50, thus severing the driving engagement between the motor 46 and the power release lever 56. Translation of the power release lever 56 along the axis E can refer to translation of the power release lever 56 relative to the gear wheel 50 and/or the backing plate 40. From the engaged position of FIG. 1, the power release lever 56 is movable vertically upward as viewed in the drawing along the axis E, away from the backing plate 40, against the bias of a bias member 60. The bias member 60 in the illustrated construction is a coil spring that extends around the power release lever 56. The bias member 60 abuts a shoulder 62 of the power release lever 56 on one end, and abuts a seat 64 on an opposite end. The seat 64 can be fixed to, or provided by, a portion of the housing 22 (FIG. 10). For example, the seat 64 can be provided by a thrust bearing fitted to an opening in the housing 22. The seat 64 allows relative movement of the power release lever 56 along the axis E, during which movement the bias member 60 is compressed. The stored energy in the bias member 60 returns the power release lever 56 to the engaged position of FIG. 1 when external forces on the power release lever 56 are removed.

Figure 5:
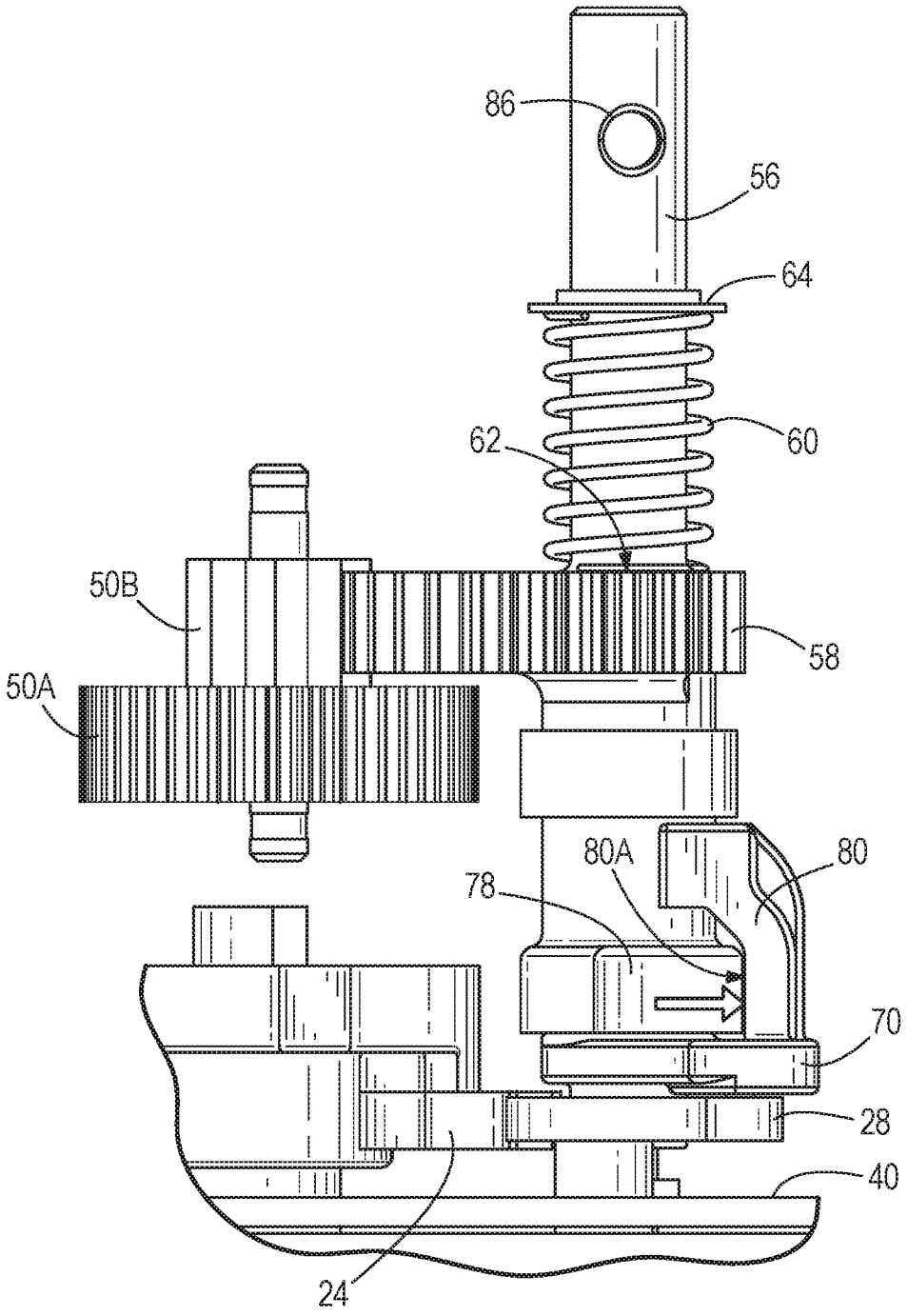
FIG. 5 is a front view of the latch assembly of FIG. 1 during normal powered release operation.

When actuated to perform a power release function, the power release lever 56 drives the release of the detent lever 28 through an additional member, or intermittent lever 70 as shown in FIG. 5. However, the power release lever 56 and the detent lever 28 are directly engaged without an intermediate member in other constructions, not illustrated. The intermittent lever 70 has a shaft portion 70A extending generally along the axis E and fitted into a complementary bore in the power release lever 56, such that the intermittent lever 70 is rotatable about the axis E, and may rotate relative to the power release lever 56. It should be noted that other arrangements and configurations are optional, and particularly, the intermittent lever 70 may be arranged for translational (non-pivoting) movement, or a combination of translational and pivoting movement in other constructions. A slip joint is provided between the intermittent lever 70 and the detent lever 28. The slip joint can be provided at a surface of the intermittent lever 70 remote from (i.e., facing away from) the power release lever 56. In the illustrated construction, the slip joint is provided by a pocket or recess 72 formed in the intermittent lever 70 and a pin or post 74 on the detent lever 28 that is received by the recess 72 with clearance. Although the slip joint allows limited relative movement, it provides a connection for engaging the detent lever 28 to a released position, away from the forkbolt 24. It is noted that the recess 72 can be a blind recess, or alternately, may extend as an opening through a portion of the intermittent lever 70. Actuation of the intermittent lever 70 for the releasing of the detent lever 28 is provided by contact from a cam 78 provided on the power release lever 56 as the power release lever 56 is rotated about the axis E by power from the motor 46 through the gear train. The cam 78 of the power release lever 56 contacts a first portion or follower surface 80A of a cam follower 80 of the intermittent lever 70. The cam follower 80 can be provided as a contoured arm with multiple portions or cam follower surfaces, as discussed in detail below. FIG. 5 illustrates the normal operation of a powered release function utilizing the cam 78 of the power release lever 56 to actuate the first follower surface 80A of the intermittent lever 70. The power release lever 56 rotates from a first, or "home", rotational orientation (FIG. 5) about the axis E in a release direction to engage the first follower surface 80A for power releasing.

Although the latch 20 provides a powered release function as described above, an additional feature incorporated directly into the power release lever 56 provides a manual release function. The manual release function can be utilized during the assembly phase (e.g., where the latch 20 is provided on a vehicle closure and the vehicle is undergoing initial factory assembly at an assembly plant) where power (e.g., electric power) may not yet be established to the latch 20. However, the manual release function may also be available at other times, due to other circumstances. For example, a vehicle operator or service technician may utilize the manual release function where vehicle battery power is too low for normal powered actuation, or power from the battery is not reaching the latch 20, or another malfunction has occurred which inhibits the normal powered release of the latch 20.

Figure 6:
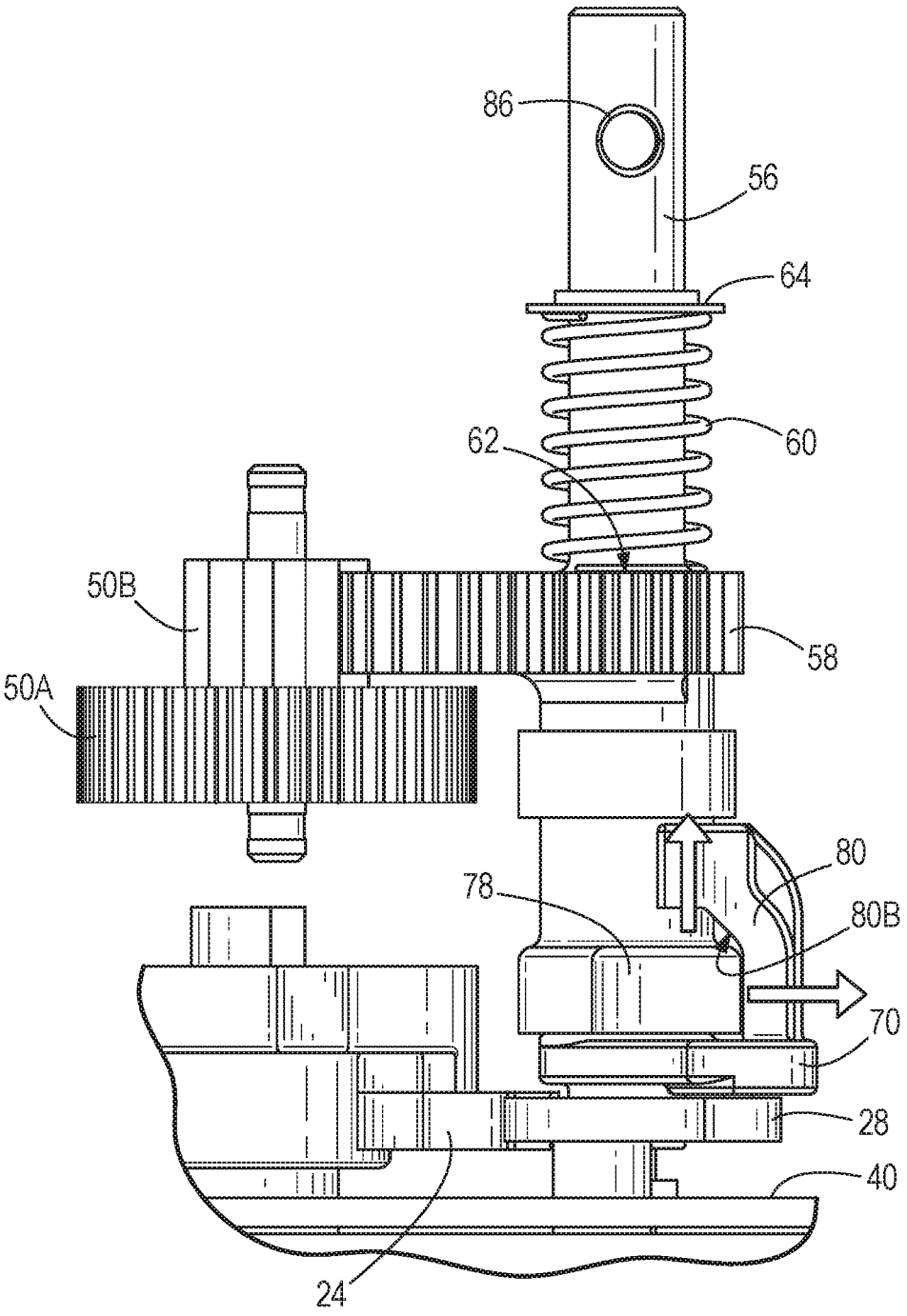
FIG. 6 is a front view of the latch assembly of FIG. 1 during manual release operation, for example, at the assembly plant prior to associating power with the latch assembly.

As shown in FIG. 6, the manual release function is accomplished by a movement of the power release lever 56 from a first position, referred to herein as a home position to a second position, referred to herein as a manual release position. The movement can be unidirectional and different from rotation about the axis E of the power release lever 56. For example, the unidirectional movement can be a movement along the axis E in a direction (e.g., away from the detent lever 28) that causes engagement between the cam 78 and a second portion or follower surface 80B of the cam follower 80. Contact between the cam 78 and the second follower surface 80B drives movement of the intermittent lever 70 in a releasing direction which operates to release the detent lever 28, thus allowing unlatching of the forkbolt 24 from the striker 32. In the illustrated construction, the engagement between the cam 78 and the second follower surface 80B drives rotational movement of the intermittent lever 70 about the axis E that is shared by the power release lever 56 and the intermittent lever 70. However, other arrangements are optional as mentioned above, which may result in other movement characteristics of the intermittent lever 70 during manual release. Engagement between the cam 78 and the second follower surface 80B as described above to release the detent lever 28 is possible when the power release lever 56 is in the first or home rotational orientation about the axis E such that the cam 78 is aligned with the second follower surface 80B for engagement when the power release lever 56 moves along the axis E to the manual release position. This is shown in FIG. 6 for example.

To aid in the actuation of the power release lever 56 for the manual release function, a tether 84 (FIGS. 9 and 10) may be coupled to the power release lever 56. In one construction, the power release lever 56 is provided with an aperture 86 at a remote end for attaching the tether 84. FIG. 6 illustrates the normal operation of a manual release function utilizing the cam 78 of the power release lever 56 to actuate the second follower surface 80B of the intermittent lever 70. It is also noted that, upon movement of the power release lever 56 along the axis E for the manual release function, the meshing engagement between the power release lever 56 and the gear wheel 50 (and thus, the motor 46) is severed by introducing an offset between the toothed portion 50B and the gear portion 58 of the power release lever 56.

Figure 7:
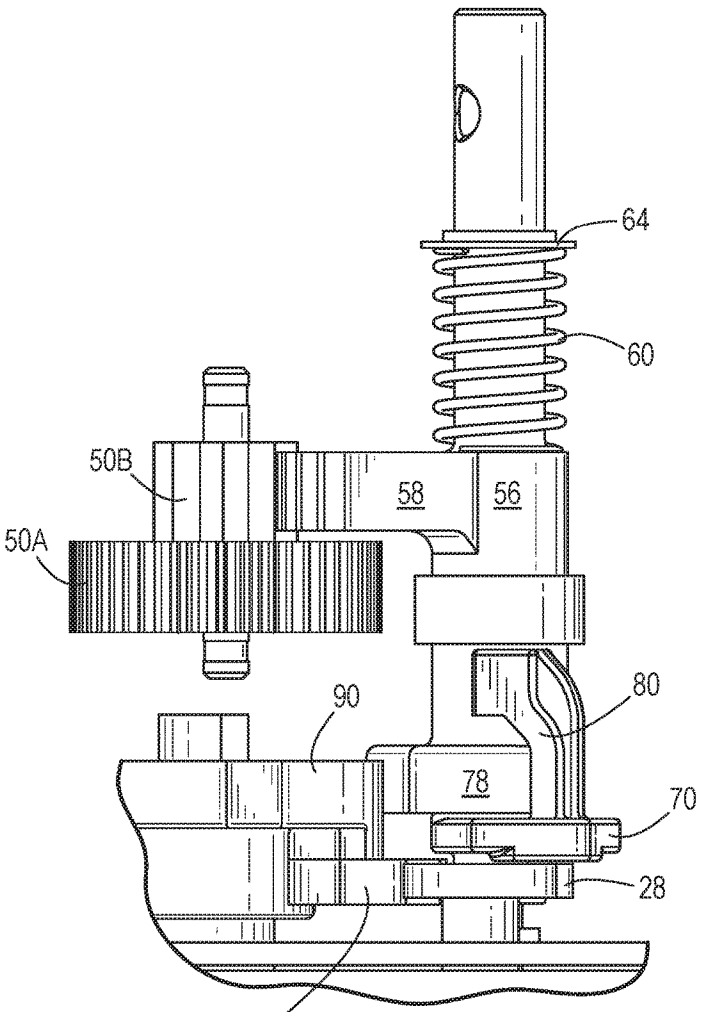
FIG. 7 is a front view of the latch assembly of FIG. 1 during a jammed cinching operation.

In some constructions, the latch 20 may further be configured to provide powered cinching of the striker 32, whereby the motor 46 is operated to apply a powered cinching force to the forkbolt 24 to pull or cinch the striker 32 toward a fully latched position. For this purpose, the motor 46 may operate in a direction opposite a direction used for power releasing, and the torque from the motor 46 is applied through the gear wheel 50 to the power release lever 56 such that the cam 78 engages the surface of a cam follower 90. As illustrated, the cam follower 90 is formed as a member separate from the forkbolt 24, but is coupled for co-rotation with the forkbolt 24 (e.g., via a complementary fitting of non-circular shapes). In other constructions, the cinching cam follower 90 may be directly integrated into the forkbolt 24. The cinching action may initiate automatically (e.g., by a microprocessor or other controller) in response to the striker 32 being brought into initial latching engagement with the forkbolt 24 (e.g., primary forkbolt 24A). The controller then actuates the motor 46 to apply the cinching force to complete the latching operation as described above. For cinching action between the cam 78 and the cinching cam follower 90, the power release lever 56 is rotated about the axis E in a cinching direction away from the first rotational orientation. This is shown in FIG. 7 for example.

Figure 8:
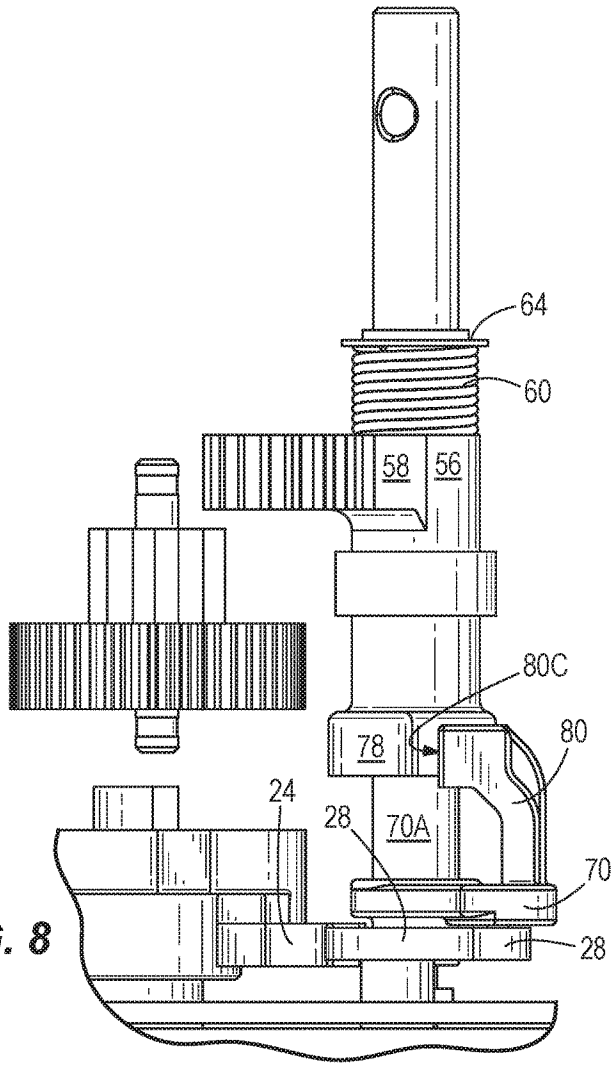
FIG. 8 is a front view of the latch assembly of FIG. 1 during release from the jammed cinching operation.
Figure 9:
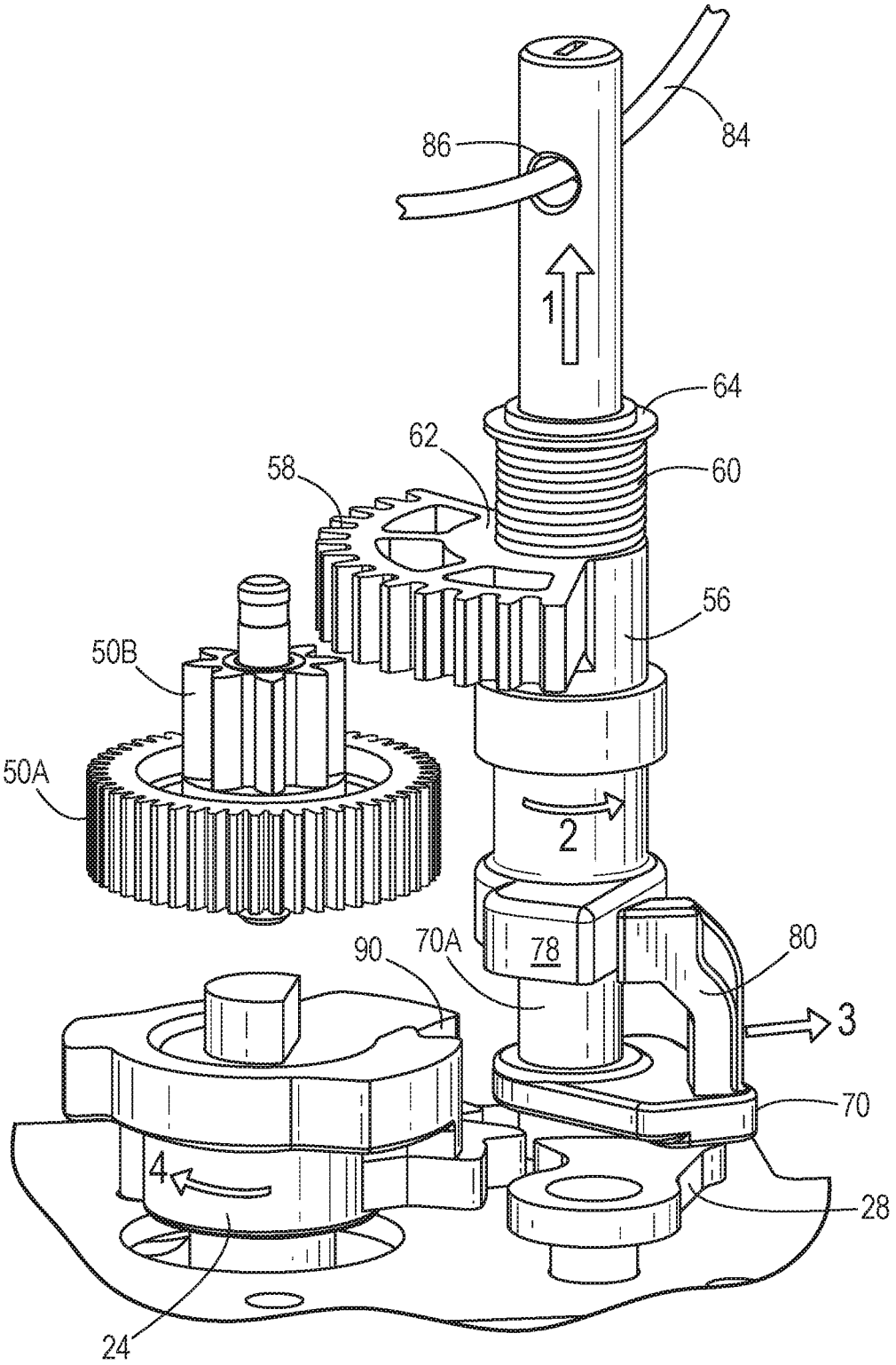
FIG. 9 is perspective view of the latch assembly of FIG. 1, illustrating the sequence of events for releasing from the jammed cinching operation and releasing the detent.

Although the cinching function may be highly reliable, there may inevitably be circumstances in which a jammed condition occurs. These may include the lack of sufficient electrical power to the motor 46 and/or obstruction by a foreign object. In such circumstances, the motor 46 resists being back-driven and holds its position, and the latch 20 must be un-jammed or reset prior to completing further operations. The manual release of a jammed cinch mechanism is a third function of the power release lever 56. Similar to the manual release function which releases the latch 20 from a closed state, movement of the power release lever 56 along the axis E is utilized to release a jammed cinch mechanism. As mentioned above, the driving connection through the gear train is severed by sufficient movement of the power release lever 56 along the axis E. This is the first step in resetting the latch 20 from a jammed cinching state as shown in FIGS. 7-9. The engagement between the cam 78 and the cinching cam follower 90 is also severed by the axial movement of the power release lever 56 as shown in FIG. 8. Upon achieving this position, manual rotation of the power release lever (in the direction of arrow 2 in FIG. 9) is carried out so that the cam 78 engages a third portion or follower surface 80C of the cam follower 80 of the intermittent lever 70. Further rotation of the power release lever 56 results in movement (e.g., rotation) of the intermittent lever 70 for releasing the detent lever 28 from the forkbolt 24 to reset the latch 20. Although the tether 86 utilized for manually releasing the latch 20 may be removed during final assembly (and thus, not available to the operator or service technician), the unjamming sequence described above may be accomplished by removing a body portion, trim panel, or cover to expose the remote end of the power release lever 56 and subsequently manipulating the power release lever 56 manually (e.g., by hand with or without a tool, such as a screwdriver, wrench, or pliers).

Once the power release lever 56 is disengaged, the bias member 60 resets the power release lever 56 back to the operable position of FIG. 1, and normal operation of the latch 20 may resume. Thus, there is no need for performing any destructive acts upon the latch 20, or even partial disassembly of the fundamental elements of the latch 20 to resolve the condition of a jammed cinching operation and reset the latch 20 back into a complete and operational state, as the latch 20 is reset immediately upon return of the power release lever 56 to the position of FIG. 7. It should be understood that manual operation of the power release lever 56 as discussed herein refers to manipulation carried out by means other than the designated powered actuator (e.g. motor 46) of the latch 20, including direct or indirect manipulation by human hands.

In a construction where no intermittent lever 70 is provided, it will be understood that features of the intermittent lever 70, such as the cam follower 80 including the cam follower surfaces 80A, 80B, 80C can be integrated or otherwise incorporated into the detent lever 28. Furthermore, it will be appreciated that each cam follower surface 80A, 80B, 80C may represent a separate cam follower, whether integrated into the unitary contoured arm of the cam follower 80 as shown, or provided as individualized features as separately contemplated herein.

Figure 4:
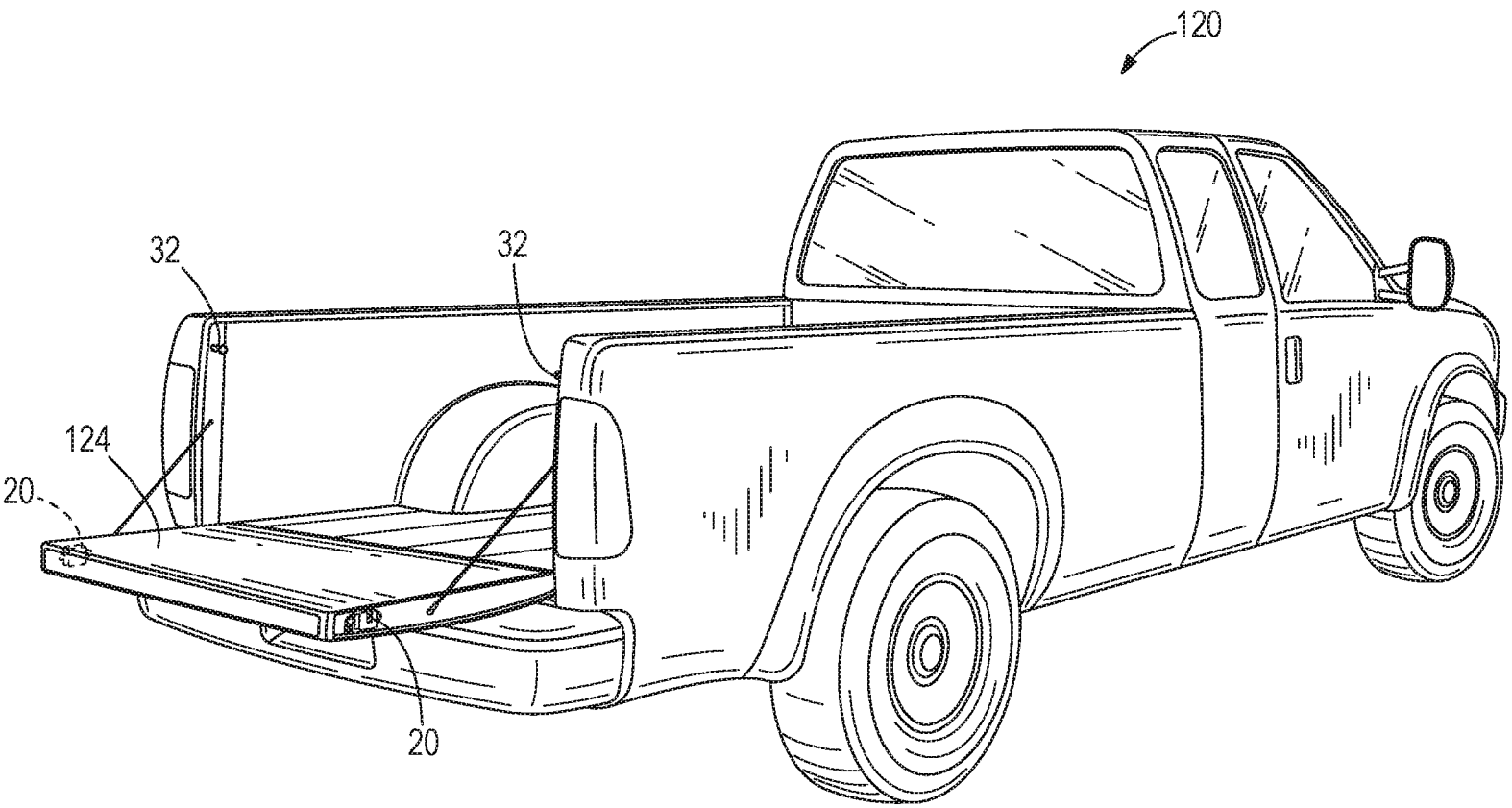
FIG. 4 is a rear perspective view of a pick-up truck including latch assemblies according to one aspect of the invention.

With specific reference to FIGS. 4 and 10, one particular vehicle application of the latch 20 is discussed. As shown in FIG. 4, a pickup truck 120 is provided with a cargo bed closable via an end gate 124 pivotally mounted to the cargo bed in a conventional manner. An opening of the cargo bed is provided with a striker 32 at each side. A latch 20 according to the above description is provided at each corresponding side of the end gate 124, so as to be selectively engageable with the respective striker 32. Thus, the two latches 20 cooperate together to selectively hold the end gate 124 in a securely closed position with respect to the cargo bed. As noted above, the strikers 32 may be provided on the end gate 124, and the latches 20 may be provided on the cargo bed, in an alternate construction. During the vehicle assembly phase when power to the latch 20 is not provided (e.g., no voltage source connected to the motor 46), the tether 84 may be coupled to the respective power release levers 56 of both latches 20 on the end gate 124, and a worker can manipulate both latches 20 to perform the manual release function with a single input action (e.g., one pull of the tether 84). Thus, the end gate 124 can be released or unlatched from the cargo bed in a simple, manual operation of the latch 20, despite the latch 20 being provided as a powered latch. In some constructions, the tether 84 is removed upon final assembly, whereby the latches 20 are associated with the corresponding power source (e.g., vehicle battery). In other constructions, the tether 84 remains with the vehicle but is concealed. If removed from the vehicle, the tether 84 may be re-used during assembly of another vehicle.

The invention claimed is:

1. A powered latch comprising:

a forkbolt pivotable about a first axis between a latched position for retaining a striker and an unlatched position for releasing the striker;

a detent lever pivotable about a second axis and engageable with the forkbolt to secure the forkbolt in the latched position;

a powered actuator; and a power release lever rotatable about a third axis by the powered actuator to release the detent lever from engagement with the forkbolt, the power release lever further being manually movable from a first position along the third axis to a second position along the third axis, wherein the manual movement of the power release lever from the first position along the third axis to the second position along the third axis is operable to release the detent lever from engagement with the forkbolt.

2. The powered latch of claim 1, wherein the powered actuator is operable in a first mode of operation to release the detent lever from engagement with the forkbolt, and is further operable in a second mode of operation to cinch the forkbolt to the latched position.

3. The powered latch of claim 2, wherein the power release lever includes a cam operable to drive the detent lever to release from engagement with the forkbolt in the first mode of operation of the powered actuator.

4. The powered latch of claim 3, wherein the cam is operable to cinch the forkbolt to the latched position in the second mode of operation of the powered actuator.

5. The powered latch of claim 2, wherein the power release lever includes a cam operable in a cinching direction on a cinching cam follower to cinch the forkbolt to the latched position in the second mode of operation of the powered actuator, and wherein the manual movement of the power release lever to the second position from the first position is operable to offset the cam from the cinching cam follower in a direction perpendicular to the cinching direction.

6. The powered latch of claim 5, wherein the power release lever further includes a gear portion that is selectively meshed with a toothed portion of a gear wheel driven by the powered actuator, and wherein the gear portion of the power release lever is disengaged from the toothed portion of the gear wheel when the power release lever is in the second position.

7. The powered latch of claim 1, further comprising an intermittent lever operable by the power release lever and operable on the detent lever to release the detent lever from engagement with the forkbolt when the power release lever is manually moved from the first position to the second position.

8. The powered latch of claim 7, wherein the intermittent lever includes a cam follower operable by a cam of the power release lever during the manual movement of the power release lever to the second position.

9. The powered latch of claim 8, wherein the cam follower is operable by the cam in a first rotational orientation of the power release lever, and wherein the intermittent lever includes an additional cam follower operable by rotation of the cam to release the detent lever from engagement with the forkbolt only after the power release lever is manually moved to the second position.

10. A powered latch comprising:

a forkbolt pivotable about a first axis between a latched position for retaining a striker and an unlatched position for releasing the striker;

a detent lever pivotable about a second axis and engageable with the forkbolt to secure the forkbolt in the latched position;

a power release lever; and a powered actuator operable to rotate the power release lever, through a coupling of the power release lever to the powered actuator, about a third axis for releasing the detent lever from engagement with the forkbolt, wherein the power release lever is manually movable from a first position along the third axis to a second position along the third axis defining a manual release position in which the power release lever is decoupled from the powered actuator, the movement to the manual release position simultaneously actuating the manual releasing of the detent lever from engagement with the forkbolt.

11. The powered latch of claim 10, wherein the powered actuator is operable in a first mode of operation to release the detent lever from engagement with the forkbolt, and is further operable in a second mode of operation to cinch the forkbolt to the latched position.

12. The powered latch of claim 11, wherein the power release lever includes a cam operable to drive the detent lever to release from engagement with the forkbolt in the first mode of operation of the powered actuator.

13. The powered latch of claim 12, wherein the cam is operable to cinch the forkbolt to the latched position in the second mode of operation of the powered actuator.

14. The powered latch of claim 11, wherein the power release lever includes a cam operable in a cinching direction on a cinching cam follower to cinch the forkbolt to the latched position in the second mode of operation of the powered actuator, and wherein the manual movement of the power release lever to the manual release position is operable to offset the cam from the cinching cam follower in a direction perpendicular to the cinching direction.

15. The powered latch of claim 10, further comprising an intermittent lever operable by the power release lever and operable on the detent lever to release the detent lever from engagement with the forkbolt when the power release lever is manually moved to the manual release position.

16. The powered latch of claim 15, wherein the intermittent lever includes a cam follower operable by a cam of the power release lever during the manual movement of the power release lever to the manual release position.

17. The powered latch of claim 16, wherein the cam follower is operable by the cam in a first rotational orientation of the power release lever, and wherein the intermittent lever includes an additional cam follower operable by rotation of the cam to release the detent lever from engagement with the forkbolt only after the power release lever is manually moved to the manual release position.

* * * * *